US007534130B2

(12) United States Patent
Tanaka et al.

(10) Patent No.: US 7,534,130 B2
(45) Date of Patent: May 19, 2009

(54) CABLE CONNECTOR

(75) Inventors: Hirohisa Tanaka, Tsu (JP); Shunsuke Hashimoto, Tsu (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/053,766

(22) Filed: Mar. 24, 2008

(65) Prior Publication Data

US 2008/0242143 A1 Oct. 2, 2008

(30) Foreign Application Priority Data

Mar. 27, 2007 (JP) ..... P2007-081567

(51) Int. Cl.
*H01R 12/24* (2006.01)

(52) U.S. Cl. ..... 439/495

(58) Field of Classification Search ..... 439/495, 439/260

See application file for complete search history.

(56) References Cited

U.S. PATENT DOCUMENTS

| | | | | |
|---|---|---|---|---|
| 6,206,723 | B1 * | 3/2001 | Kunishi | 439/495 |
| 6,224,418 | B1 * | 5/2001 | Miura et al. | 439/495 |
| 6,471,541 | B2 * | 10/2002 | Kunishi et al. | 439/495 |
| 6,517,367 | B2 * | 2/2003 | Yamane | 439/260 |
| 6,755,682 | B2 * | 6/2004 | Kunishi et al. | 439/495 |
| 7,052,300 | B2 * | 5/2006 | Okita et al. | 439/260 |
| 7,267,574 | B2 * | 9/2007 | Wei et al. | 439/495 |
| 7,275,948 | B2 * | 10/2007 | Miura et al. | 439/260 |
| 7,275,954 | B2 * | 10/2007 | Ikenaga et al. | 439/494 |
| 2002/0045374 | A1 * | 4/2002 | Kunishi et al. | 439/260 |
| 2002/0115340 | A1 * | 8/2002 | Yamane | 439/495 |
| 2005/0118849 | A1 * | 6/2005 | Okita et al. | 439/260 |
| 2006/0252302 | A1 * | 11/2006 | Wei et al. | 439/495 |
| 2006/0258227 | A1 | 11/2006 | Ookura | |
| 2007/0049119 | A1 | 3/2007 | Fujimoto et al. | |

(Continued)

FOREIGN PATENT DOCUMENTS

| | | |
|---|---|---|
| JP | 2001-110483 | 4/2001 |

(Continued)

OTHER PUBLICATIONS

English language Abstract of JP 2001-110483.

(Continued)

*Primary Examiner*—T C Patel
*Assistant Examiner*—Vladimir Imas
(74) *Attorney, Agent, or Firm*—Greenblum & Bernstein, P.L.C.

(57) ABSTRACT

A cable connector includes a housing, a first contact having a first contact unit opposed to a front surface of a cable and an engaging and pivoting unit opposed to a back surface of the cable, a second contact which is provided in the housing and which has a second contact unit opposed to the front surface of the cable and a wall opposed to the back surface of the cable, and a cover which is turnably supported on the engaging and pivoting unit by a through hole into which the engaging and pivoting unit is inserted and a cam unit engaged with the engaging and pivoting unit. The engaging and pivoting unit is engaged with the cam unit so that the cover can move in an inserting and releasing direction of the cable. The wall limits movement of the cover in an inserting direction of the cable.

4 Claims, 6 Drawing Sheets

U.S. PATENT DOCUMENTS

| | | | | |
|---|---|---|---|---|
| 2007/0054529 | A1 * | 3/2007 | Harlan et al. | 439/260 |
| 2007/0105408 | A1 | 5/2007 | Ookura | |
| 2007/0105423 | A1 * | 5/2007 | Gillespie et al. | 439/260 |
| 2007/0161274 | A1 | 7/2007 | Tanaka et al. | |

FOREIGN PATENT DOCUMENTS

| | | | |
|---|---|---|---|
| JP | 2001-307805 | A | 11/2001 |
| JP | 2002-025662 | A | 1/2002 |
| JP | 2004-022187 | A | 1/2004 |
| JP | 2004-087361 | A | 3/2004 |
| JP | 2005-116495 | A | 4/2005 |
| JP | 2006-024373 | A | 1/2006 |

OTHER PUBLICATIONS

English language Abstract of JP 2006-024373 A (Jan. 26, 2006).
English language Abstract of JP 2002-025662 A (Jan. 25, 2002).
English language Abstract of JP 2001-307805 A (Nov. 2, 2001).
English language Abstract of JP 2004-022187 A (Jan. 22, 2004).
English language Abstract of JP 2004-087361 A (Mar. 18, 2004).
English language Abstract of JP 2005-116495 A (Apr. 28, 2005).

* cited by examiner

CABLE CONNECTOR

CROSS REFERENCE TO RELATED APPLICATIONS

This application is based upon and claims the benefit of priority from prior Japanese Patent Application P2007-081567 filed on Mar. 27, 2007; the entire contents of which are incorporated by reference herein.

BACKGROUND OF THE INVENTION

The present invention relates to a cable connector, and more particularly, to a cable connector suitable for connecting a cable such as a flat ribbon cable and FPC.

As a conventional cable connector, Japanese Patent Application Laid-open No. 2001-110483 (hereinafter, Patent Document 1) discloses a cable connector including a housing that receives an FPC cable, a plurality of first and second contacts fixed and held by the housing with a predetermined pitch, and an actuator that brings the FPC cable into contact with the first and second contacts under pressure.

According to the Patent Document 1, the first and second contacts are respectively integrally provided with first and second contact units which are opposed to one of surfaces of the FPC cable, and first and second engaging and pivoting units which are opposed to the opposite surface of the FPC cable. An outer periphery of the first engaging and pivoting unit is formed into an arc shape, and the arc first cam unit formed on the actuator and the arc first engaging and pivoting unit are engaged with each other. The actuator is formed with a through hole which is adjacent to the first cam unit such that the first engaging and pivoting unit runs around the first cam unit. With this configuration, the actuator is supported by the first engaging and pivoting unit such that the actuator can turn.

SUMMARY OF THE INVENTION

According to this conventional technique, however, the first engaging and pivoting unit of the first contact is engaged such that the first cam unit of the actuator is restrained from moving in three directions, i.e., upward, an inserting direction of the cable and a separating direction. Therefore, when the actuator is closed, there is a problem that a friction force generated between the first engaging and pivoting unit and the first cam unit is increased, the operating force of the actuator is increased and the operability is deteriorated.

Therefore, an object of the present invention is to provide a cable connector in which the operability when the cable is fixed is excellent.

To achieve the above object, the present invention provides a cable connector comprising a housing, a first contact which is provided in the housing and into which a sheet-like cable is inserted, and which includes a first contact unit opposed to a front surface of the cable and an engaging and pivoting unit opposed to a back surface of the cable, a second contact which is provided in the housing in a side-by-side relation with the first contact, into which a cable is inserted, and which has a second contact unit opposed to the front surface of the cable and a wall opposed to the back surface of the cable, and a cover which has a through hole through which the engaging and pivoting unit is inserted and a cam unit which is engaged with the engaging and pivoting unit, which is turnably supported on the engaging and pivoting unit by the through hole and the cam unit, and which brings the cable into contact with the contact units under pressure, wherein the engaging and pivoting unit is engaged with the cam unit so that the cover can move in an inserting and releasing direction of the cable, and the wall limits movement of the cover in an inserting direction of the cable.

It is preferable to be configured that the wall includes an inclined portion, and the cover includes an abutting portion which abuts against the inclined portion when the cover is closed.

Further, it is preferable to be configured that the abutting portion projects from the cover.

DETAILED DESCRIPTION OF THE PREFERRED EMBODIMENTS

Embodiments of the present invention will be explained below in detail with reference to the drawings.

First Embodiment

Figure 1:
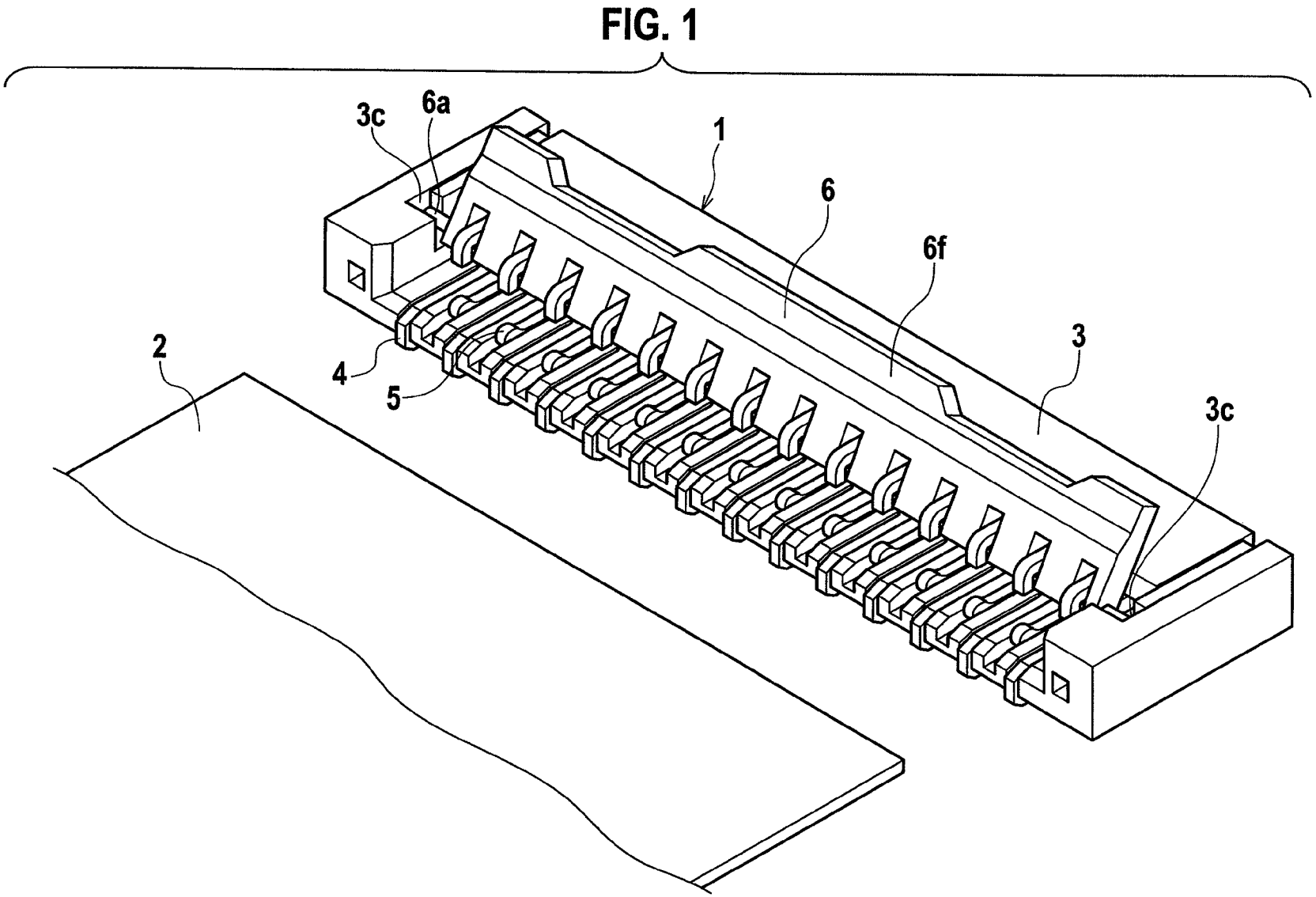
FIG. 1 is a perspective view of an external appearance of a cable connector according to a first embodiment of the present invention.
Figure 2:
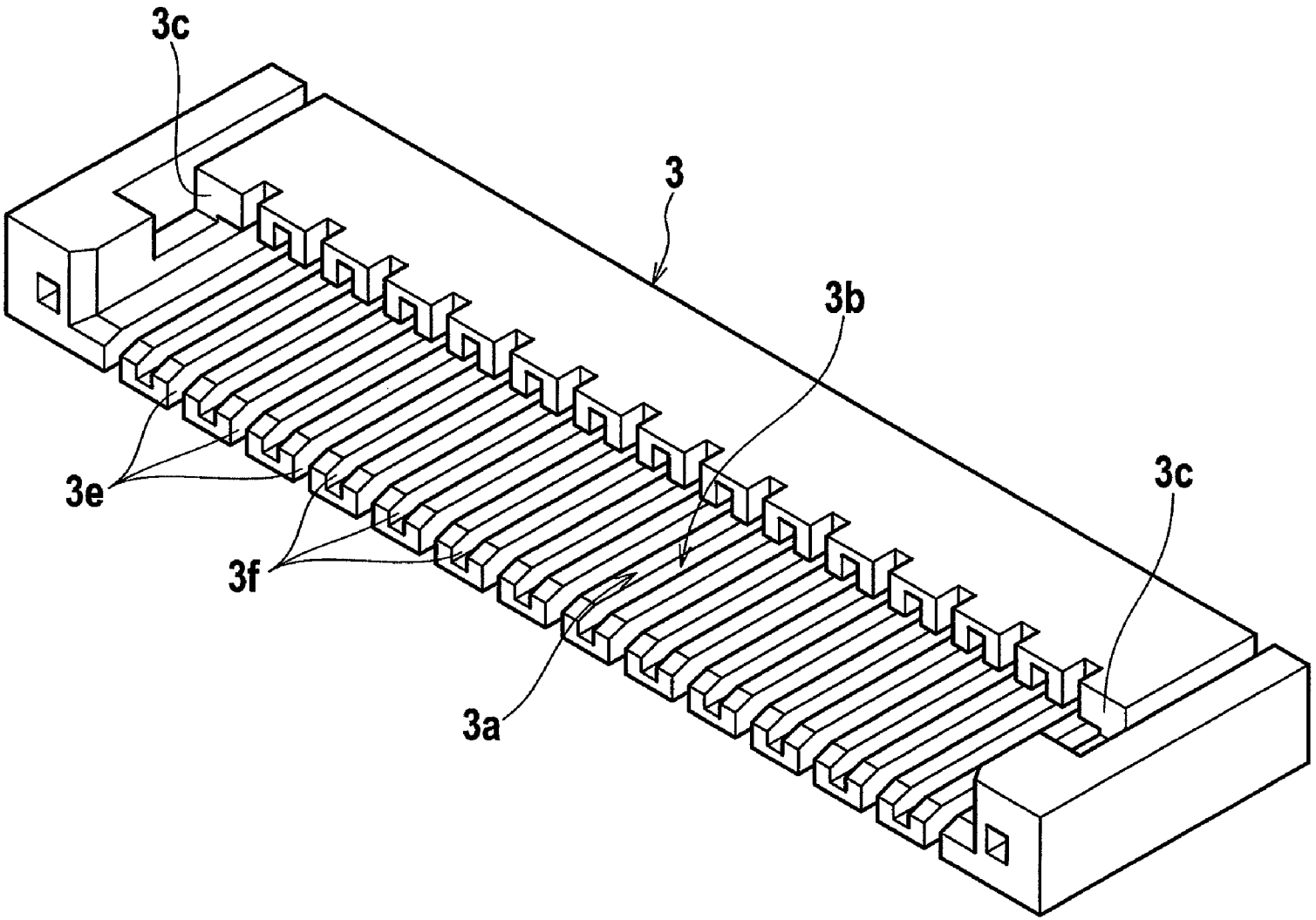
FIG. 2 is a perspective view of an external appearance of a housing of the cable connector according to the first embodiment.
Figure 3:
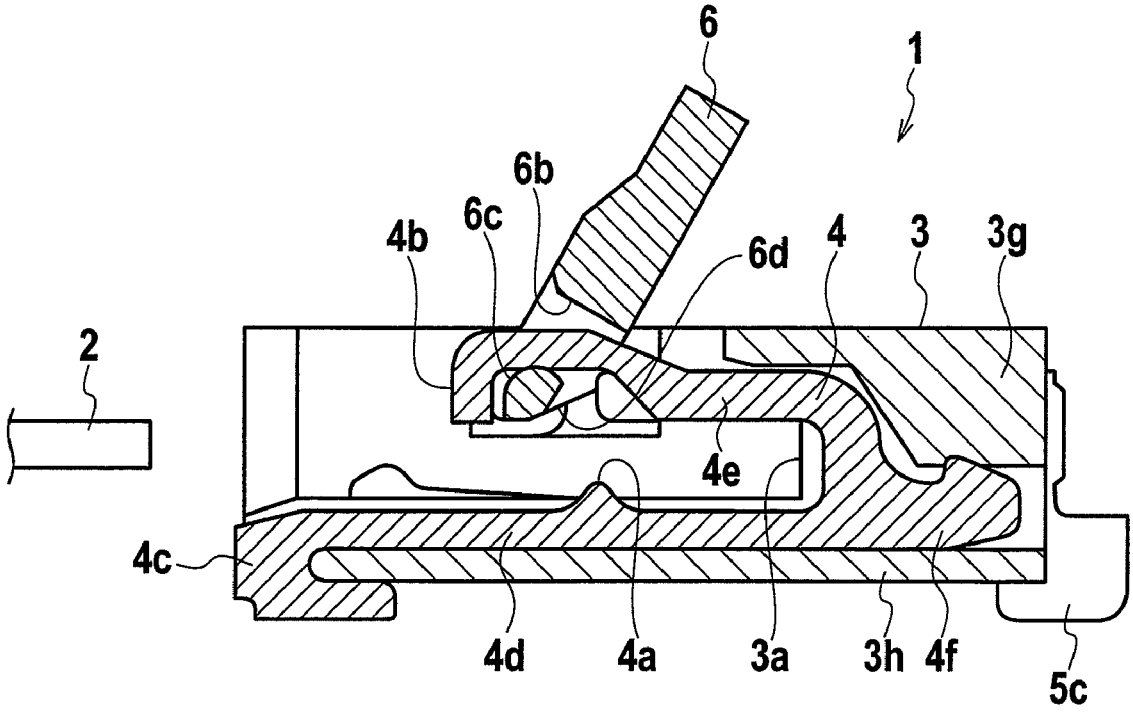
FIG. 3 is a sectional view of a first contact of the cable connector according to the first embodiment and shows a state where a cover is opened.
Figure 4:
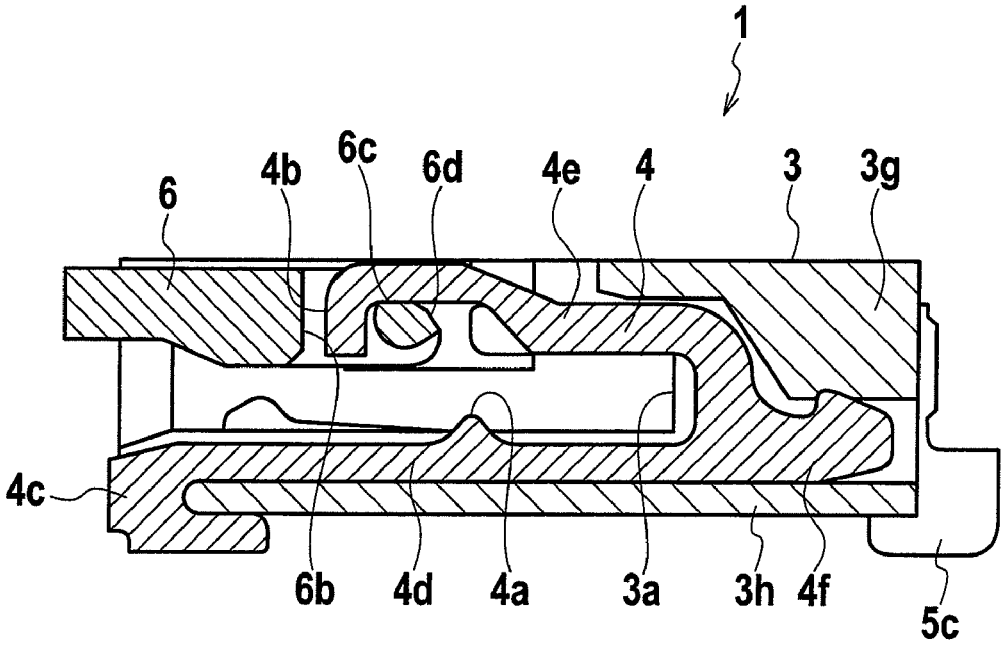
FIG. 4 is a sectional view of the first contact of the cable connector according to the first embodiment and shows a state where the cover is closed.
Figure 5:
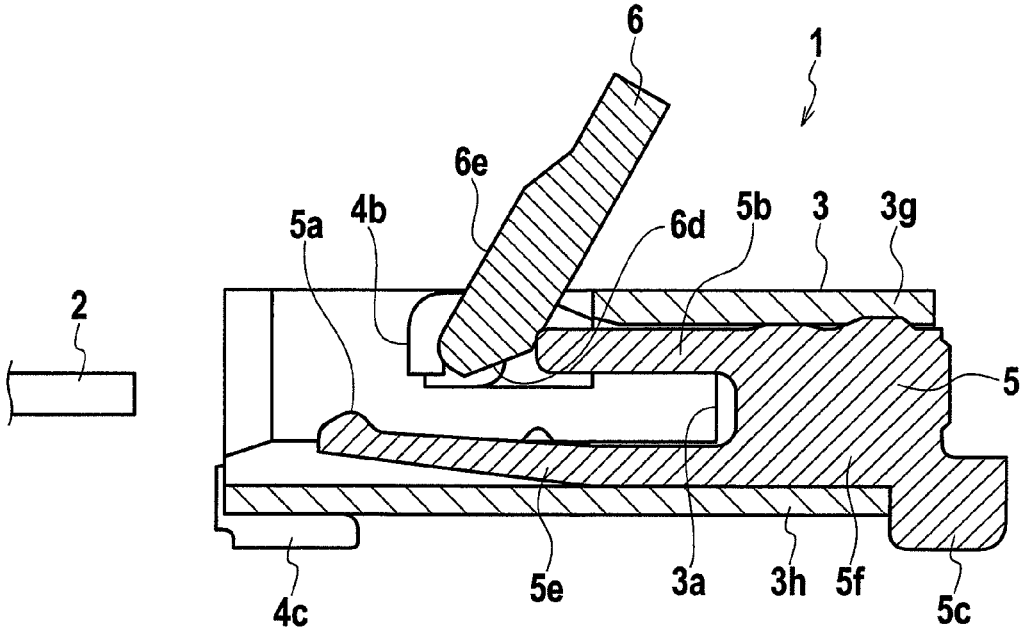
FIG. 5 is a sectional view of a second contact of the cable connector according to the first embodiment and shows a state where a cover is opened.
Figure 6:
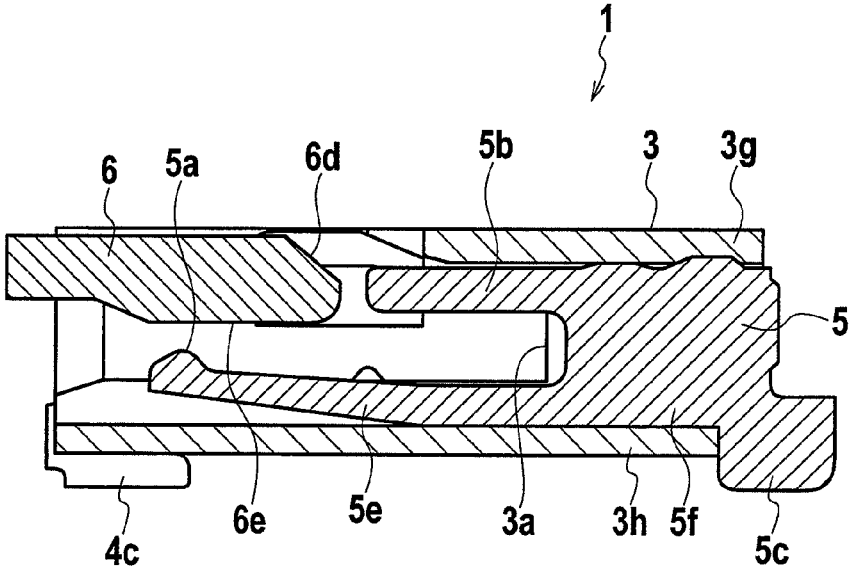
FIG. 6 is a sectional view of the second contact of the cable connector according to the first embodiment and shows a state where the cover is closed.

FIG. 1 is a perspective view of an external appearance of a cable connector according to a first embodiment of the present invention, FIG. 2 is a perspective view of an external appearance of a housing, FIG. 3 is a sectional view of a first contact and shows a state where a cover is opened, FIG. 4 is a sectional view of the first contact and shows a state where the cover is closed, FIG. 5 is a sectional view of a second contact and shows a state where the cover is opened, and FIG. 6 is a sectional view of the second contact and shows a state where the cover is closed.

A cable connector 1 includes an insulative housing 3 into which a sheet cable 2 such as FPC or FFC, having front surface and back surface. The cable connector 1 includes a plurality of insulative first contacts 4 which are arranged in one row at a predetermined pitch in the housing 3 and fixed and held therein. The first contact 4 includes a first contact unit 4*a* opposed to the front surface of the cable 2 and an engaging and pivoting unit 4*b* opposed to the back surface of the cable 2. The cable connector 1 also includes a plurality of insulative second contacts 5 held in the housing 3 in parallel to the first contacts 4. The second contacts 5 include a second contact unit 5*a* opposed to the front surface of the cable 2 and a wall 5*b* opposed to the back surface of the cable 2. The cable connector 1 also includes an insulative cover 6 which can turn between an open position where the cable 2 can be inserted into the housing 3 and a close position where the cable 2 inserted into the housing 3 can be pushed toward the first and second contact units 4*a* and 5*a*.

The housing 3 is made of insulative material such as synthetic resin. The housing 3 is formed at its vertically substantially intermediate portion with a bag-like cable receiving unit 3*a* into which the cable 2 is inserted from front (left side in FIG. 3).

A large number of conductors (not shown) are longitudinally exposed in two rows in a staggered form from a surface (lower surface in FIG. 3) of an insertion end of the cable 2.

A substantially half of an inlet side (front side) of an upper wall 3*g* of the housing 3 is removed, and an upper opening 3*b* for accommodating the cover 6 is formed at that portion.

Bearings 3*c* are formed at both ends of the upper opening 3*b* of the housing 3. Upper sides of the bearings 3*c* are opened. The bearings 3*c* are opposed to each other in the longitudinal direction of the housing 3.

The cover 6 is a plate-like member which can be accommodated in the upper opening 3*b* of the housing 3. The cover 6 is also made of insulative material such as synthetic resin. Pivot shafts 6*a* projects from base ends of left and right end surfaces of the cover 6. In the first embodiment, the left and right pivot shafts 6*a* of the cover 6 are fitted into the left and right bearings 3*c* of the housing 3 from above the housing 3. With this configuration, the cover 6 is mounted on the upper opening 3*b* of the housing 3 such that the cover 6 can open and close (turn).

The cover 6 turns from an open position shown in FIGS. 3 and 5 to a close position shown in FIGS. 4 and 6. When the cover 6 is in the close position, the cover 6 assumes substantially horizontal attitude and is accommodated in the upper opening 3*b*, and the cover 6 pushes the cable 2 toward the contact units 4*a* and 5*a* (downward in FIG. 3). On the other hand, when the cover 6 is in the open position, the cover 6 rises from the upper opening 3*b* of the housing 3 in a backward inclined standing attitude, and a substantially half of the inlet side of the cable receiving unit 3*a* is opened above the housing 3 so that the cable 2 can be inserted into the cable receiving unit 3*a* of the housing 3. The cover 6 is provided with a knob 6*f* for opening the cover 6.

The first contacts 4 and the second contacts 5 are alternately arranged along the longitudinal direction of the housing 3. The first contacts 4 and the second contacts 5 are formed by punching a thin metal plate.

The first contacts 4 and the second contacts 5 are inserted into the housing 3 from two opposite directions. More specifically, the housing 3 is formed with a large number of first holes 3*e* into which the first contacts 4 are inserted one by one from front (inlet side) to back (deep side) of the housing 3, i.e., in the insertion direction of the cable 2 (from left to right in FIG. 3), and with a large number of second holes 3*f* into which the second contacts 5 are inserted from back (deep side) to front (inlet side) of the housing 3, i.e., in the separating direction of the cable 2 (from right to left in FIG. 5) one by one. The first contacts 4 and the second contacts 5 are alternately arranged in the housing 3 side-by-side in the longitudinal direction with the predetermined pitch through the first holes 3*e* and the second holes 3*f*. That is, the insertion amounts of the first contacts 4 and the second contacts 5 into the housing 3 can be adjusted.

The first contact 4 includes a base portion 4*f* which is fitted between upper and lower walls 3*g* and 3*h* at a deeper side than the cable receiving unit 3*a* of the housing 3, a lower arm unit 4*d* which extends from a lower end of the base portion 4*f* to an inlet side front surface along the lower wall 3*h* of the housing 3 and which is arranged below the cable receiving unit 3*a*, and an upper arm unit 4*e* which extends to the upper opening 3*b* along the upper wall 3*g* of the housing 3 from the upper end of the base portion 4*f* and which is arranged above the cable receiving unit 3*a*.

The base portion 4*f* is provided at its upper edge with a projection. If the projection bites into the upper wall 3*g* of the housing 3 in the first hole 3*e*, the first contact 4 can be locked to the housing 3.

The lower arm unit 4*d* is formed at its substantially intermediate portion with the first contact unit 4*a*, and a stopper 4*c* projects downward from the tip end lower edge. The stopper 4*c* limits the maximum insertion amount of the first contact 4 into the housing 3 when the first contact 4 is inserted into the first hole 3*e* of the housing 3. The stopper 4*c* also serves as amounting soldering portion projecting from a lower surface of the cable connector 1. As shown in FIG. 4, it projects downward from a tip end of the lower arm unit 4*d*.

A substantially hook-like engaging and pivoting unit 4*b* is formed on a tip end of the upper arm unit 4*e* such that it can elastically deform in the vertical direction, and the engaging and pivoting unit 4*b* projects toward the upper opening 3*b*. In the first embodiment, the engaging and pivoting unit 4*b* projects in the separating direction of the cable 2 than the position of the first contact unit 4*a*.

The second contact 5 includes a base portion 5*f* which is fitted in between the upper and lower walls 3*g* and 3*h* at a deeper side than the cable receiving unit 3*a* of the housing 3, a lower arm unit 5*e* which extends from a lower end of the base portion 5*f* along the lower wall 3*h* of the housing 3 and which is arranged below the cable receiving unit 3*a*, and the wall 5*b* which extends from the upper end of the base portion 5*f* along the upper wall 3*g* of the housing 3 and which is arranged above the cable receiving unit 3*a*.

The base portion 5*f* is provided at its upper edge with a projection. If the projection bites into the upper wall 3*g* of the housing 3 in the second hole 3*f*, the second contact 5 is locked to the housing 3. A stopper 5*c* projects downward from a lower edge of the base portion 5*f*. The stopper 5*c* limits the maximum insertion amount of the second contact 5 into the housing 3 when the second contact 5 is inserted into the second hole 3*f* of the housing 3. The stopper 5*c* also serves as a surface mounting soldering portion projecting toward the lower surface of the cable connector 1. As shown in FIG. 6, the stopper 5*c* projects downward from the tip end of the lower arm unit 5*e*.

The lower arm unit 5*e* is formed at its tip end with the second contact unit 5*a*. The lower arm unit 5*e* can elastically deform. If the cable 2 is inserted, the lower arm unit 5*e* elastically deforms downward so that an upper biasing force is applied.

In a state where the first contacts 4 and the second contacts 5 are mounted in the housing 3 in this manner, the first contact units 4*a* of the first contacts 4 and the second contact units 5*a* of the second contacts 5 are arranged in one row in the housing 3. As a result, the entire first and second contact units 4*a* and 5*a* are arranged in the staggered manner by the first contact units 4*a* of the first contacts 4 arranged in one row in the insertion direction of the cable 2 and the second contact units 5*a* of the second contacts 5 arranged in one row in the separating direction of the cable 2, and they can come into contact with the large number of conductors which are exposed in the staggered manner provided on the surface of the cable 2.

In the first embodiment, the engaging and pivoting unit 4*b* is arranged in the housing 3 at a position above a location between the row of the first contact units 4*a* of the first contacts 4 and the row of the second contact units 5*a* of the second contacts 5.

The cover 6 is provided with a through hole 6*b* in correspondence with the engaging and pivoting unit 4*b* provided on the first contact 4. A cam unit 6*c* which turns when the cover 6 turns is formed on the cover 6 at a location adjacent to the through hole 6*b*. If the engaging and pivoting unit 4*b* of the first contact 4 is engaged with the cam unit 6*c*, the cover 6 is turnably supported by the engaging and pivoting unit 4*b*. In the first embodiment, as shown in FIG. 3, the engaging and pivoting unit 4*b* of the first contact 4 is engaged with the cam unit 6*c* with play therebetween so that the cam unit 6*c* can move in the inserting and releasing direction (inserting direction and releasing direction of the cable 2). Since the engaging and pivoting unit 4*b* of the first contact 4 is engaged with the cam unit 6*c* with play therebetween so that the cam unit 6*c* can move in the inserting and releasing direction of the cable 2 in this manner, a friction force generated between the engaging and pivoting unit 4*b* and the cam unit 6*c* is reduced.

As shown in FIGS. 5 and 6, the wall 5*b* of the second contact 5 limits the movement of the cable 2 in the inserting direction. The wall 5*b* of the second contact 5 also has a function as a stopper which limits the turning motion of the cover 6 in the opening direction.

An outer surface of the cover 6 which is directed opposite side from the cable 2 when the cover 6 is in the close position is formed with an inclined surface 6*d* so that an end of the cover does not hinder the inserting motion of the cable 2 when the cover is opened. An inclined surface is also provided on the cam unit 6*c* at a location corresponding to the inclined surface 6*d*, and the inclined surface 6*d* of the cover 6 and the inclined surface of the cam unit 6*c* are flush with each other.

Cable pressing units 6*e* are formed on an inner surface of the cover 6 which is opposed to the cable 2 when the cover 6 is in the close position. The cable pressing unit 6*e* downwardly pushes the cable 2. The cable pressing units 6*e* project between the through holes 6*b* in the inner surface of the cover 6.

According to the first embodiment having the structure described above, if the cover 6 is opened, the cable 2 can easily be inserted into the cable receiving unit 3*a*.

If the cover 6 is turned to the close position shown in FIGS. 4 and 6 after the cable 2 is inserted, the cable pressing unit 6*e* on the lower surface of the cover 6 presses the cable 2 toward the first contact unit 4*a* and the second contact unit 5*a*. With this configuration, the first contact unit 4*a*, the second contact unit 5*a* and the contact of the cable 2 are engaged with each other under appropriate contact pressure and they are electrically connected. That is, the cable 2 is sandwiched between the lower surface of the cover 6, the first contact unit 4*a* and the second contact unit 5*a*, the lower arm unit 5*e* is elastically deformed downward by an amount corresponding to the thickness of the cable 2, and appropriate contact pressure is obtained by the elastic force.

According to the first embodiment, the engaging and pivoting unit 4*b* of the first contact 4 is engaged through the play so that the cam unit 6*c* of the cover 6 can be moved in the inserting and releasing direction of the cable 2. Therefore, the engaging and pivoting unit 4*b* does not limit the movement of the cam unit 6*c* in the inserting and releasing direction (inserting direction and separating direction) of the cable 2, and it is possible to prevent a large friction force from being generated between the engaging and pivoting unit 4*b* and the cam unit 6*c* when the cover 6 is opened or closed, and the cover 6 can be opened and closed excellently.

According to the first embodiment, the wall 5*b* of the second contact 5 limits the movement of the cover 6 in the inserting direction of the cable 2. Therefore, even if the cam unit 6*c* of the cover 6 is engaged through the play so that the cam unit 6*c* of the cover 6 can move in the inserting and releasing direction of the cable 2, since the movement of the cover 6 in the inserting and releasing direction of the cable 2 is suppressed, it is possible to suppress the saccadic movement when the cover 6 is opened or closed.

In the first embodiment, the turning center formed by engagement between the cam unit 6*c* of the cover 6 and the engaging and pivoting unit 4*b* of the first contact 4 is located above a position between the row of the first contact units 4*a* of the first contacts 4 and the row of the second contact units 5*a* of the second contacts 5. Therefore, the cover 6 can turn at a position where the cable 2 between the first contact unit 4*a* of the first contact 4 and the second contact unit 5*a* of the second contact 5 is prone to deform, and the cover 6 can be opened and closed more excellently.

If the inserting amount of the first contact 4 and the second contact 5 into the housing 3 is appropriately set, there is an advantage that the turning center of the cover 6 and the relative position between the first contact unit 4*a* and the second contact unit 5*a* are changed and a cable connector having better operability can be obtained.

Second Embodiment

Figure 7:
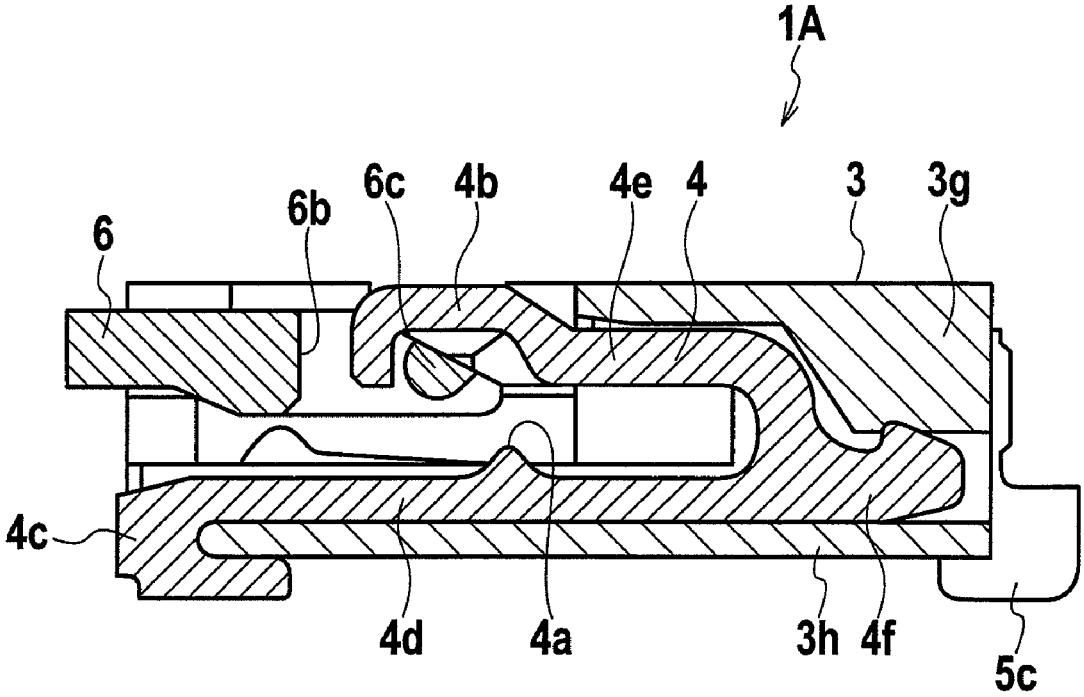
FIG. 7 is a sectional view of a first contact of a cable connector according to a second embodiment of the present invention and shows a state where a cover is closed.
Figure 8:
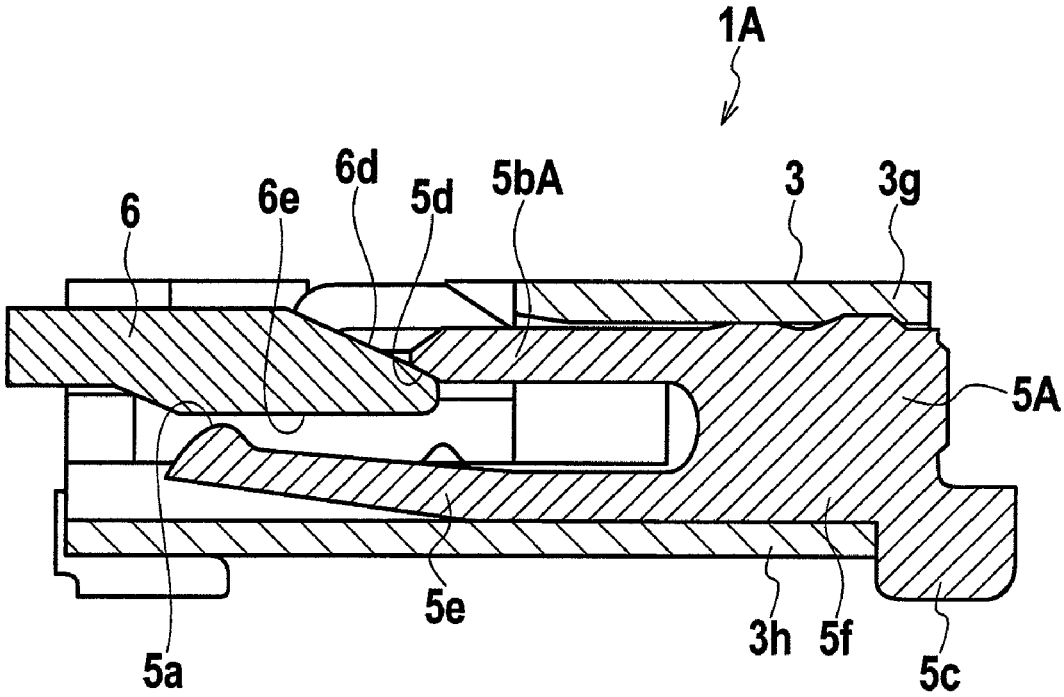
FIG. 8 is a sectional view of a second contact of the cable connector according to the second embodiment and shows a state where a cover is closed.

FIG. 7 is a sectional view of a first contact of a cable connector according to a second embodiment of the present invention, and shows a state where a cover is closed, and FIG. 8 shows a state where the cover is closed. The cable connector according to the second embodiment has like constituent elements as those of the cable connector according to the first embodiment. Thus, like constituent elements are designated with like reference symbols and redundant explanations thereof will be omitted.

In the cable connector 1A according to the second embodiment, an inclined portion 5*d* is provided on a tip end of a wall 5*b* A provided on an upper portion of a second contact 5A. The second embodiment is different from the first embodiment in that when the cover 6 is closed, the inclined portion 5*d* and the inclined surface 6*d* provided on the cover 6 abut against each other. That is, in the second embodiment, the inclined surface 6*d* of the cover 6 corresponds to an abutment unit. When the cover 6 is closed when the cable 2 is fixed, the inclined portion 5*d* limits the movement of the cover 6 in the inserting direction of the cable 2 and upward movement thereof.

Like the first embodiment, the engaging and pivoting unit 4*b* of the first contact 4 is engaged through play so that the cam unit 6*c* of the cover 6 can move in the inserting and releasing direction of the cable 2.

The second embodiment can achieve the same effects of the first embodiment.

According to the second embodiment, the wall 5*b* A of the second contact unit 5*a* is provided with the inclined portion 5*d*, and the cover 6 is provided with the inclined surface (abutting portion) 6*d* which comes into contact with the inclined portion 5*d*. With this configuration, if the cover 6 is closed when the cable 2 is fixed, the inclined portion 5*d* and the inclined surface (abutting portion) 6*d* limit the movement of the cover 6 in the inserting direction of the cable 2 and upward movement thereof. As a result, it is possible to suppress a case that the cover 6 which is closed when the cable is fixed is adversely opened, and the reliability of connection of the cable connector 1A can be enhanced.

Third Embodiment

Figure 9:
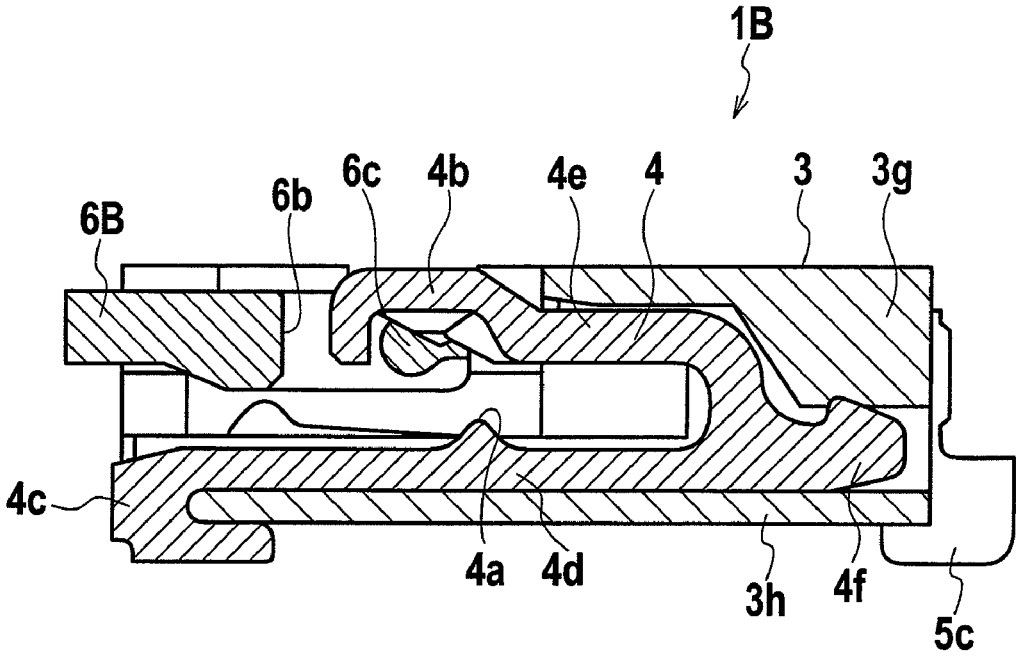
FIG. 9 is a sectional view of a first contact of a cable connector according to a third embodiment of the present invention and shows a state where a cover is closed.
Figure 10:
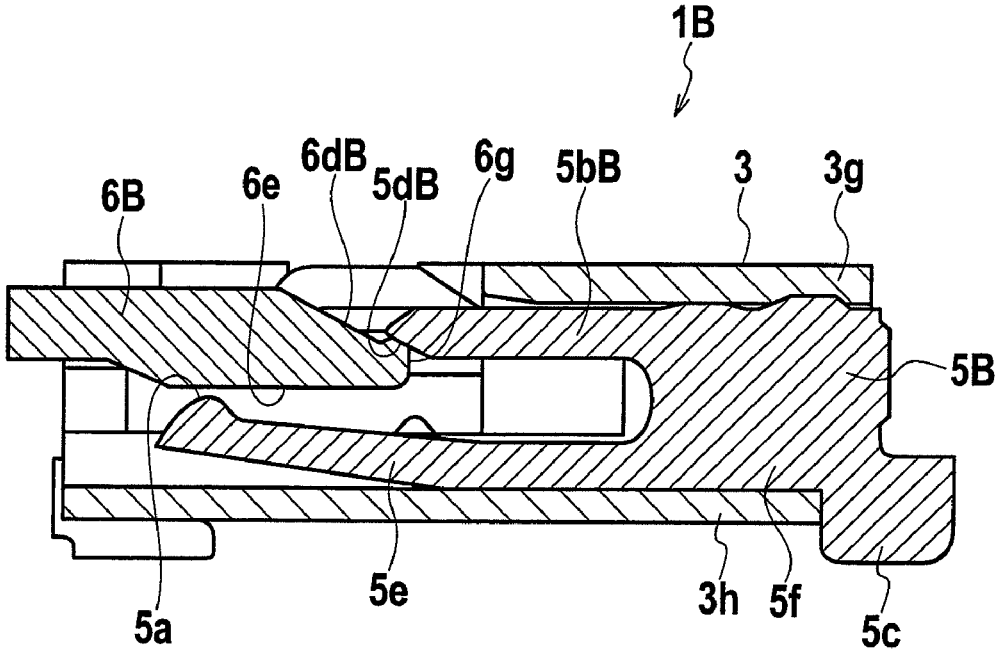
FIG. 10 is a sectional view of a second contact of the cable connector according to the third embodiment and shows a state where a cover is closed.

FIG. 9 is a sectional view of a first contact of a cable connector according to a third embodiment of the present invention and shows a state where a cover is closed, and FIG. 10 shows a state where the cover is closed. The cable connector according to the third embodiment has like constituent elements as those of the cable connector of the first embodiment. Thus, like constituent elements are designated with like reference symbols and redundant explanations thereof will be omitted.

The third embodiment is different from the first and second embodiments in that in the cable connector 1B according to the third embodiment, an inclined surface 6*d*B of a cover 6B is provided with a projection 6*g*, an inclined portion 5*d* is provided on a tip end of the wall 5*b*B provided on an upper portion of the second contact 5B, the inclined portion 5*d*B and the inclined surface 6*d*B provided on the cover 6B abut against each other. That is, in the third embodiment, the projection 6*g* of the cover 6 corresponds to the abutting portion. Like the second embodiment, when the cover 6B is closed when the cable 2 is fixed, the inclined portion 5*d*B limits the movement of the cover 6B in the inserting direction of the cable 2 and upward movement thereof.

Like the first and second embodiments, the engaging and pivoting unit 4*b* of the first contact 4 is engaged through play such that the cam unit 6*c* of the cover 6B can move in the inserting and releasing direction of the cable 2.

The third embodiment can achieve the same effects of the first and second embodiments.

According to third embodiment, since the projection (abutting portion) 6*g* project from the cover 6B, it is possible to prevent the cover 6B from increasing in thickness to a minimum, and it is possible to prevent the strength of the cover 6B from being deteriorated.

While the cable connector according to the exemplary embodiments of the present invention has been explained above, the present invention is not limited thereto and can also adopt various other embodiments without departing from the scope of the invention.

What is claimed is:

1. A cable connector comprising:

a housing, a first contact which is provided in the housing and into which a sheet-like cable is inserted, and which includes a first contact unit opposed to a front surface of the cable and an engaging and pivoting unit opposed to a back surface of the cable, a second contact which is provided in the housing in a side-by-side relation with the first contact, into which the cable is inserted, and which has a second contact unit opposed to the front surface of the cable and a wall opposed to the back surface of the cable, and a cover which has a through hole through which the engaging and pivoting unit is inserted and a cam unit which is engaged with the engaging and pivoting unit, which is turnably supported on the engaging and pivoting unit by the through hole and the cam unit, and which brings the cable into contact with the contact units under pressure, wherein the engaging and pivoting unit is engaged with the cam unit so that the cover can move in an inserting and releasing direction of the cable, and the wall limits movement of the cover in an inserting direction of the cable.

2. The cable connector according to claim 1, wherein the wall includes an inclined portion, and the cover includes an abutting portion which abuts against the inclined portion when the cover is closed.

3. The cable connector according to claim 2, wherein the abutting portion projects from the cover.

4. The cable connector according to claim 1, wherein the first contact further includes a lower arm unit and a stopper projecting from a tip end of the lower arm unit.

* * * * *